US009152095B1

(12) United States Patent
Zaretsky et al.

(10) Patent No.: US 9,152,095 B1
(45) Date of Patent: Oct. 6, 2015

(54) DETERMINING TRANSFER BIAS SETTINGS IN ELECTROPHOTOGRAPHIC PRINTING

(71) Applicants: Mark Cameron Zaretsky, Rochester, NY (US); Rodney Ray Bucks, Webster, NY (US); Kevin Edward Spaulding, Spencerport, NY (US)

(72) Inventors: Mark Cameron Zaretsky, Rochester, NY (US); Rodney Ray Bucks, Webster, NY (US); Kevin Edward Spaulding, Spencerport, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/316,868

(22) Filed: Jun. 27, 2014

(51) Int. Cl.
*G03G 15/16* (2006.01)

(52) U.S. Cl.
CPC ..... *G03G 15/1675* (2013.01)

(58) Field of Classification Search
USPC ..... 399/38, 46, 49, 66, 72
See application file for complete search history.

(56) References Cited

U.S. PATENT DOCUMENTS

| | | | | |
|---|---|---|---|---|
| 5,963,756 | A | 10/1999 | Sakai et al. | |
| 6,147,698 | A * | 11/2000 | Zable et al. | 347/240 |
| 6,427,062 | B1 * | 7/2002 | Takeuchi | 399/388 |
| 6,477,339 | B1 | 11/2002 | Yano et al. | |
| 6,608,641 | B1 | 8/2003 | Alexandrovich et al. | |
| 6,728,503 | B2 | 4/2004 | Stelter et al. | |
| 6,985,678 | B2 | 1/2006 | Maebashi et al. | |
| 7,120,379 | B2 | 10/2006 | Eck et al. | |
| 7,151,902 | B2 | 12/2006 | Rakov et al. | |
| 7,308,212 | B2 * | 12/2007 | Hamada et al. | 399/49 |
| 7,340,191 | B2 | 3/2008 | Yamada | |
| 7,450,871 | B2 | 11/2008 | Yamada | |
| 8,019,246 | B2 | 9/2011 | Yamada | |
| 8,687,989 | B2 | 4/2014 | Zaretsky | |
| 8,737,854 | B2 | 5/2014 | Zaretsky | |
| 2006/0133870 | A1 | 6/2006 | Ng et al. | |

* cited by examiner

*Primary Examiner* — Hoan Tran
(74) *Attorney, Agent, or Firm* — Kevin E. Spaulding

(57) ABSTRACT

A method for determining transfer bias settings in an electrophotographic printing system having a plurality of printing modules, each printing module including a respective transfer subsystem operated at an associated transfer bias setting. The method includes defining a plurality of test transfer bias sets, each test transfer bias set including a transfer bias setting for the transfer subsystem in each of the printing modules. For each of the defined test transfer bias sets, a plurality of process control patches are transferred onto a measurement surface, wherein the process control patches include a monochrome patch printed using a particular printing module and at least one multi-color patch. A monochrome transfer function and a multi-color transfer function are determined characterizing the amount of the transferred toner as a function of the transfer bias, and are used to determine a transfer bias setting for the particular printing module.

19 Claims, 8 Drawing Sheets

305

| SET # | TRANSFER BIAS CURRENT (μA) | | | | |
|---|---|---|---|---|---|
| | $B_Y$ | $B_M$ | $B_C$ | $B_K$ | $B_5$ |
| 1 | 15 | 15 | 15 | 15 | 15 |
| 2 | 20 | 20 | 20 | 20 | 20 |
| 3 | 25 | 25 | 25 | 25 | 25 |
| 4 | 30 | 30 | 30 | 30 | 30 |
| 5 | 35 | 35 | 35 | 35 | 35 |

*FIG. 6A*

305

| SET # | TRANSFER BIAS CURRENT (μA) | | | | |
|---|---|---|---|---|---|
| | $B_Y$ | $B_M$ | $B_C$ | $B_K$ | $B_5$ |
| 1 | 30 | 15 | 15 | 15 | 15 |
| 2 | 30 | 20 | 20 | 20 | 20 |
| 3 | 30 | 25 | 25 | 25 | 25 |
| 4 | 30 | 30 | 30 | 30 | 30 |
| 5 | 30 | 35 | 35 | 35 | 35 |

*FIG. 6B*

305

| SET # | TRANSFER BIAS CURRENT (μA) | | | | |
|---|---|---|---|---|---|
| | $B_Y$ | $B_M$ | $B_C$ | $B_K$ | $B_5$ |
| 1 | 30 | 22 | 15 | 15 | 15 |
| 2 | 30 | 22 | 20 | 20 | 20 |
| 3 | 30 | 22 | 25 | 25 | 25 |
| 4 | 30 | 22 | 30 | 30 | 30 |
| 5 | 30 | 22 | 35 | 35 | 35 |

*FIG. 6C*

DETERMINING TRANSFER BIAS SETTINGS IN ELECTROPHOTOGRAPHIC PRINTING

FIELD OF THE INVENTION

This invention pertains to the field of electrophotographic printing and more particularly to compensating for variations.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (i.e., a "latent image").

After the latent image is formed, charged toner particles are brought into the vicinity of the photoreceptor and are attracted to the latent image to develop the latent image into a visible image. Note that the "visible image" may little or no visibility to the naked eye depending on the composition of the toner particles (e.g., clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The magnitude of electric field to be applied to transfer an appropriate amount of toner depends on a variety of factors. Examples of such factors include the resistance of a transfer member, the toner charge-to-mass, the ambient environment (temperature and relative humidity or absolute moisture content), physical and electrical properties of a receiver (thickness, width, resistivity), the machine printing speed, and the side of the receiver being printed upon.

A variety of methods have been developed in the art for setting image formation parameters, including a transfer bias level, in response to measurements made of various imaging system attributes.

U.S. Pat. No. 5,963,756 to Sakai et al., entitled "Color correction in a color image formation apparatus," discloses the formation and measurement of monochrome and multicolor patch densities and adjusting color image formation process parameters based upon these measurements. The measured patch density values are compared to target values and the differences between the measured and target values are used to change the image formation condition.

U.S. Pat. No. 6,477,339 to Yano et al., entitled "Image forming apparatus with current detector and voltage control based on detection result," describes measuring the resistance of a transfer belt by applying a constant current and measuring the voltage required to sustain that current.

U.S. Pat. No. 6,985,678 to Maebashi et al., entitled "Color image forming apparatus and control method therefor," discloses the formation and measurement of monochrome and multicolor patch densities and adjusting color image formation process parameters based upon these measurements. The measured patch density values are compared to target values and the differences between the measured and target values are used to change the image formation condition.

U.S. Pat. No. 7,151,902 to Rakov et al., entitled "Toner transfer technique," discloses an algorithm that varies the transfer bias current depending upon a control voltage value that is linearly proportional to the toner charge-to-mass raito. A potential drawback with this approach is that the control voltage value may vary due to factors other than toner charge-to-mass, resulting in an erroneous adjustment to the transfer bias current.

U.S. Pat. No. 7,340,191 to Yamada, entitled "Image forming apparatus featuring variably-controlling a primary-transferring condition based on a detection result of combined toner images," discloses a method for controlling a bias current in an electrostatic transfer system. The method includes measuring the density of a single color patch and a multicolor patch. If the difference between the measured densities exceeds a predefined threshold, the bias current is reduced.

U.S. Pat. No. 7,450,871 to Yamada, entitled "Image forming apparatus with an adjustment function for adjusting color taste of toner image," discloses forming mixed toner images on a transferring medium, detecting the mixed toner images, and controlling a transferring condition based on the detection result to adjust a color preference.

U.S. Pat. No. 8,019,246 to Yamada, entitled "Image forming apparatus," discloses the adjustment of a transfer bias level based upon the measurement of the resistance of a transfer member in combination with a measurement of the absolute moisture content.

U.S. Pat. No. 8,687,989, entitled "Transfer unit with compensation for variation," by Zaretsky discloses the use of a charger to estimate the variation in electrical properties of a static dissipative member and controllably adjust the electric transfer field to compensate for the estimated variation.

U.S. Pat. No. 8,737,854, entitled "Printing system with receiver capacitance estimation," by Zaretsky discloses the use of a charger and non-contact voltmeter to estimate the capacitance of a receiver and subsequently adjust the transfer power source to produce an electrostatic transfer field commensurate with the estimated capacitance.

However, none of the above prior art characterize the transfer performance using in-situ measurements of monochrome and multi-chrome patches, and determine an optimal transfer bias level based upon this characterization.

There remains a need for an improved method to determine transfer bias settings in an electrophotographic printing system having a plurality of printing modules.

SUMMARY OF THE INVENTION

The present invention represents a method for determining transfer bias settings in an electrophotographic printing system having a plurality of printing modules, each printing module including a respective transfer subsystem operated at an associated transfer bias setting adapted to transfer a respective toner image of a respective color channel to a receiver medium, comprising:

defining a plurality of test transfer bias sets, each test transfer bias set including a transfer bias setting for the transfer subsystem in each of the printing modules;

for each of the defined test transfer bias sets, transferring toner for a plurality of process control patches onto a measurement surface using the transfer subsystems of the printing modules, each transfer subsystem being operated at the respective transfer bias setting, wherein the plurality of process control patches includes a monochrome patch printed using a first toner corresponding to a first color channel corresponding to a particular printing module and at least one multi-color patch printed using the first toner and at least one additional toner corresponding to at least one additional color channel;

performing measurements to characterize amounts of the first toner on the transferred process control patches;

analyzing the measured toner amounts to determine a monochrome transfer function characterizing the amount of the first toner in the transferred monochrome patches as a function of the transfer bias for the transfer subsystem in the particular printing module;

analyzing the measured toner amounts to determine a multi-color transfer function characterizing the amount of the first toner in the transferred multi-color patches as a function of the transfer bias for the transfer subsystem in the particular printing module; and determining the transfer bias setting for the transfer subsystem in the particular printing module responsive to the monochrome transfer function and the multi-color transfer function.

This invention has the advantage that an in-situ characterization of the transfer performance of the printing system can be performed.

It has the additional advantage that compensation can be effected for the operating condition of the printing system in its local environment and physical state, including any particular deviations from nominal tolerance aims in the subsystem hardware (e.g. critical-to-function spacing between sub-systems), as well as particular electrical and physical characteristics of the toner not easily measurable in a direct manner within the printing system (such as toner charge-to-mass or particle size distribution).

It has the further advantage that the method eliminates the need for complex and costly empirical testing during product development for extensive characterization of transfer performance, resulting in a predetermined transfer function algorithm or look-up table that is not robust or flexible to variations in the state of the printing system.

BRIEF DESCRIPTION OF THE DRAWINGS

FIGS. 6A-6C illustrate exemplary test transfer bias sets; and

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

In the following description, some embodiments will be described in terms that would ordinarily be implemented as software programs. Those skilled in the art will readily recognize that the equivalent of such software can also be constructed in hardware. Because data-manipulation algorithms and systems are well known, the present description will be directed in particular to algorithms and systems forming part of, or cooperating more directly with, methods described herein. Other aspects of such algorithms and systems, and hardware or software for producing and otherwise processing data signals involved therewith, not specifically shown or described herein, are selected from such systems, algorithms, components, and elements known in the art. Given the system as described herein, software not specifically shown, suggested, or described herein that is useful for implementation of various embodiments is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice methods according to various embodiments.

Figure 1:
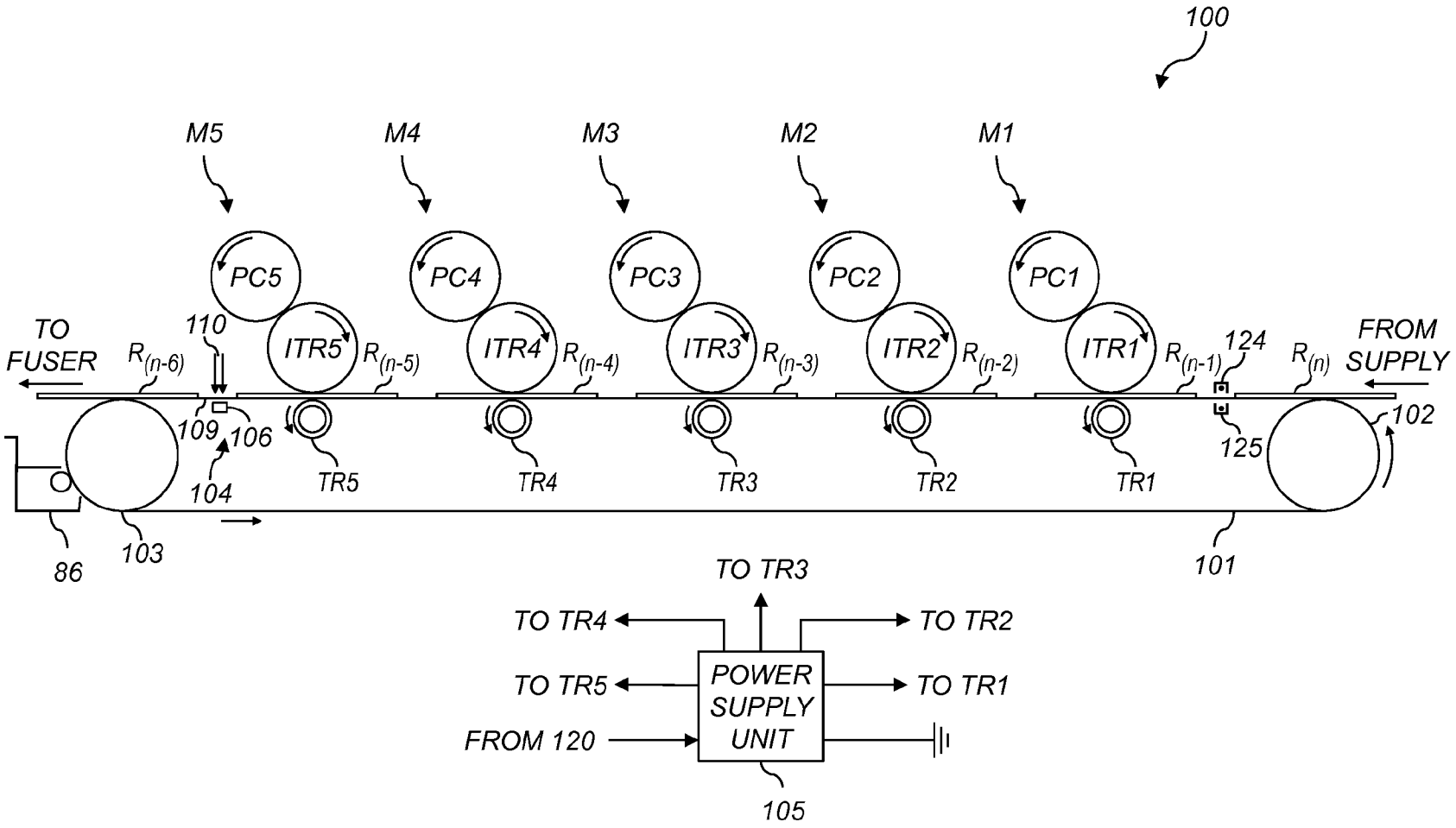
FIG. 1 is a schematic side view of an electrophotographic printer suitable for use with various embodiments.

FIG. 1 shows a simplified side elevational view of an electrophotographic color printer apparatus 100 including five tandemly arranged image-forming modules M1, M2, M3, M4, M5. Each of the image-forming modules M1, M2, M3, M4, M5 generates single-color toner images for transfer to receiver media R successively moved through the image-forming modules M1, M2, M3, M4, M5. Each receiver medium R can have transferred in registration thereto up to five single-color toner images. In a particular embodiment, image-forming module M1 forms black toner images, image-forming module M2 forms yellow toner images, image-forming module M3 forms magenta toner images, and image-forming module M4 forms cyan toner images. Image-forming module M5 can be used optionally to deposit a clear or colorless toner image, or alternatively to deposit a specialty color toner image such as for making proprietary logos or for expanding the color gamut of a resulting print.

Receiver media R are delivered from a supply (not shown) and transported through the image-forming modules M1, M2, M3, M4, M5. The receiver media R are adhered (e.g., electrostatically via coupled corona chargers 124, 125) to an endless transport web 101 entrained around and driven by rollers 102, 103. Each of the image-forming modules M1, M2, M3, M4, M5 includes a respective photoconductive imaging roller PC1, PC2, PC3, PC4, PC5, an intermediate transfer roller ITR1, ITR2, ITR3, ITR4, ITR5, and a transfer backup roller TR1, TR2, TR3, TR4, TR5. Thus in image-forming module M1, a black toner image can be created on photoconductive imaging roller PC1, transferred to intermediate transfer roller ITR1, and transferred again to a sheet of receiver medium $R_{(n-1)}$ moving through a transfer station, which includes a pressure nip formed between the intermediate transfer roller ITR1 and the transfer backup roller TR1. Similar processes occur in the other image-forming modules M2, M3, M4, M5.

A receiver medium $R_n$, arriving from the supply, is shown passing over roller 102 for subsequent entry into the transfer station of the first image-forming module, M1, in which the preceding receiver medium $R_{(n-1)}$ is shown. Similarly, sheets of receiver media $R_{(n-2)}$, $R_{(n-3)}$, $R_{(n-4)}$, and $R_{(n-5)}$ are shown moving respectively through the transfer stations of image-forming modules M2, M3, M4, and M5, respectively. An unfused print formed on receiver medium $R_{(n-6)}$ is moving as shown toward a fuser (not shown) for fusing the unfused print.

The transport web 101 is reconditioned for reuse at cleaning station 86 by cleaning and neutralizing the charges on the opposed surfaces of the transport web 101. A mechanical cleaning station (not shown) for scraping or vacuuming toner off transport web 101 can also be used independently or with cleaning station 86. The mechanical cleaning station can be disposed along the transport web 101 before or after cleaning station 86 in the direction of rotation of transport web 101.

A power supply unit 105 provides individual transfer currents to the transfer backup rollers TR1, TR2, TR3, TR4 and TR5, respectively. A densitometer module, preferably positioned in a location between the last image-forming module M5 and roller 103, includes a densitometer module 104 (utilizing one or more light beams 110 and sensors 106). As will be described in more detail in connection with FIG. 3, the densitometer module 104 measures optical densities of a set of process control patches. In some embodiments, the process control patches are printed onto a sheet of the receiver medium R. In other embodiments, the process control patches can be transferred directly onto the transport web 101, for example in an inter-frame area 109 between sheets of the receiver medium R. In accordance with the present invention, a set of process control patches are measured using the densitometer module 104. One or more signals are then transmitted from the densitometer module 104 to a control unit 120 (FIG. 3) and corresponding signals are sent from the control unit 120 to the power supply unit 105 to specify appropriate transfer currents to be provided to the transfer backup rollers TR1, TR2, TR3, TR4 and TR5 in order to control the transfer of the toner from the intermediate transfer rollers ITR1, ITR2, ITR3, ITR4, ITR5 to the receiver medium R.

Figure 2:
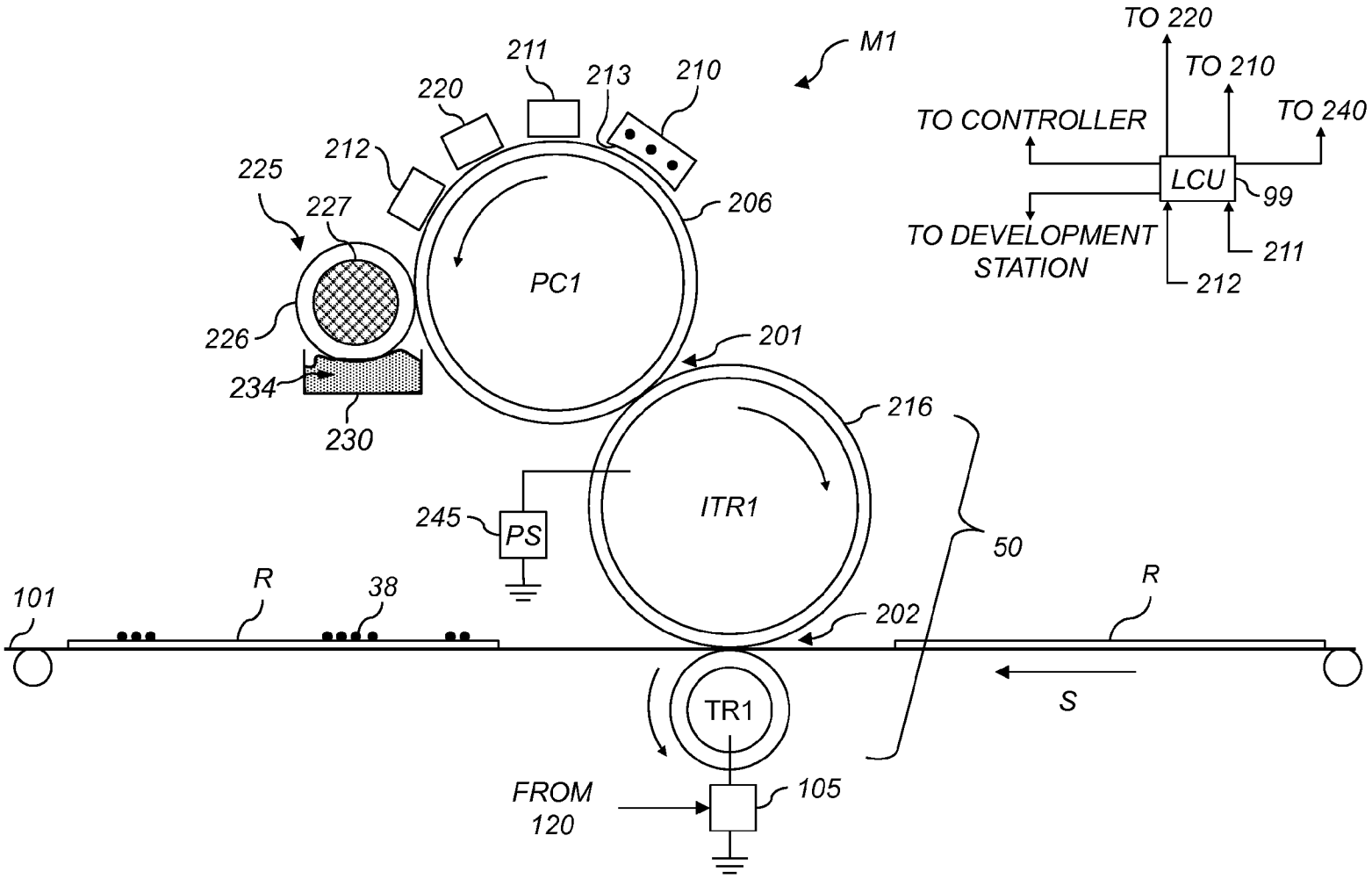
FIG. 2 is a schematic side view of one image forming module of the electrophotographic printer of FIG. 1.

FIG. 2 shows additional details of image forming module M1, which is representative of image forming modules M2, M3, M4 and M5 (FIG. 1). Photoreceptor 206 of imaging roller PC1 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging roller PC1. Photoreceptors can include a homogeneous layer of a single material such as vitreous selenium or a composite layer containing a photoconductor and another material. Photoreceptor 206 can also contain multiple layers.

Primary charging subsystem 210 uniformly electrostatically charges photoreceptor 206 of imaging roller PC1. Charging subsystem 210 includes a grid 213 having a selected voltage. Additional necessary components provided for control can be assembled about the various process elements of the respective image forming modules. Meter 211 measures the uniform electrostatic charge provided by charging subsystem 210.

An exposure subsystem 220 is provided for selectively modulating the uniform electrostatic charge on photoreceptor 206 in an image-wise fashion by exposing photoreceptor 206 to electromagnetic radiation to form a latent electrostatic image. The uniformly-charged photoreceptor 206 is typically exposed to actinic radiation provided by selectively activating particular light sources in an LED array or a laser device outputting light directed onto photoreceptor 206. In embodiments using laser devices, a rotating polygon (not shown) is used to scan one or more laser beam(s) across the photoreceptor in the fast-scan direction. One pixel site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each pixel site in the row during that line exposure time.

As used herein, an "engine pixel" is the smallest addressable unit on photoreceptor 206 which the exposure subsystem 220 (e.g., the laser or the LED) can expose with a selected exposure different from the exposure of another engine pixel. Engine pixels can overlap (e.g., to increase addressability in the slow-scan direction S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

In a preferred embodiment, a meter 212 is provided to measure the post-exposure surface potential within a patch area of a latent image formed from time to time in a non-image area on photoreceptor 206. Other meters and components can also be included (not shown).

A development station 225 includes toning shell 226, which can be rotating or stationary, for applying toner of a selected color to the latent image on photoreceptor 206 to produce a visible image on photoreceptor 206 (e.g., of a separation corresponding to the color of toner deposited at this image forming module). Development station 225 is electrically biased by a suitable respective voltage to develop the respective latent image, which voltage can be supplied by a power supply (not shown). Developer 234 is provided to toning shell 226 by a developer supply 230, which can include components such as a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In some embodiments, the development station 225 employs a two-component developer that includes toner particles and magnetic carrier particles. The exemplary development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., and in U.S. Pat. No. 6,728,503 to Stelter et al., the disclosures of which are incorporated herein by reference. Development station 225 can also employ a mono-component developer comprising toner, either magnetic or non-magnetic, without separate magnetic carrier particles.

Figure 3:
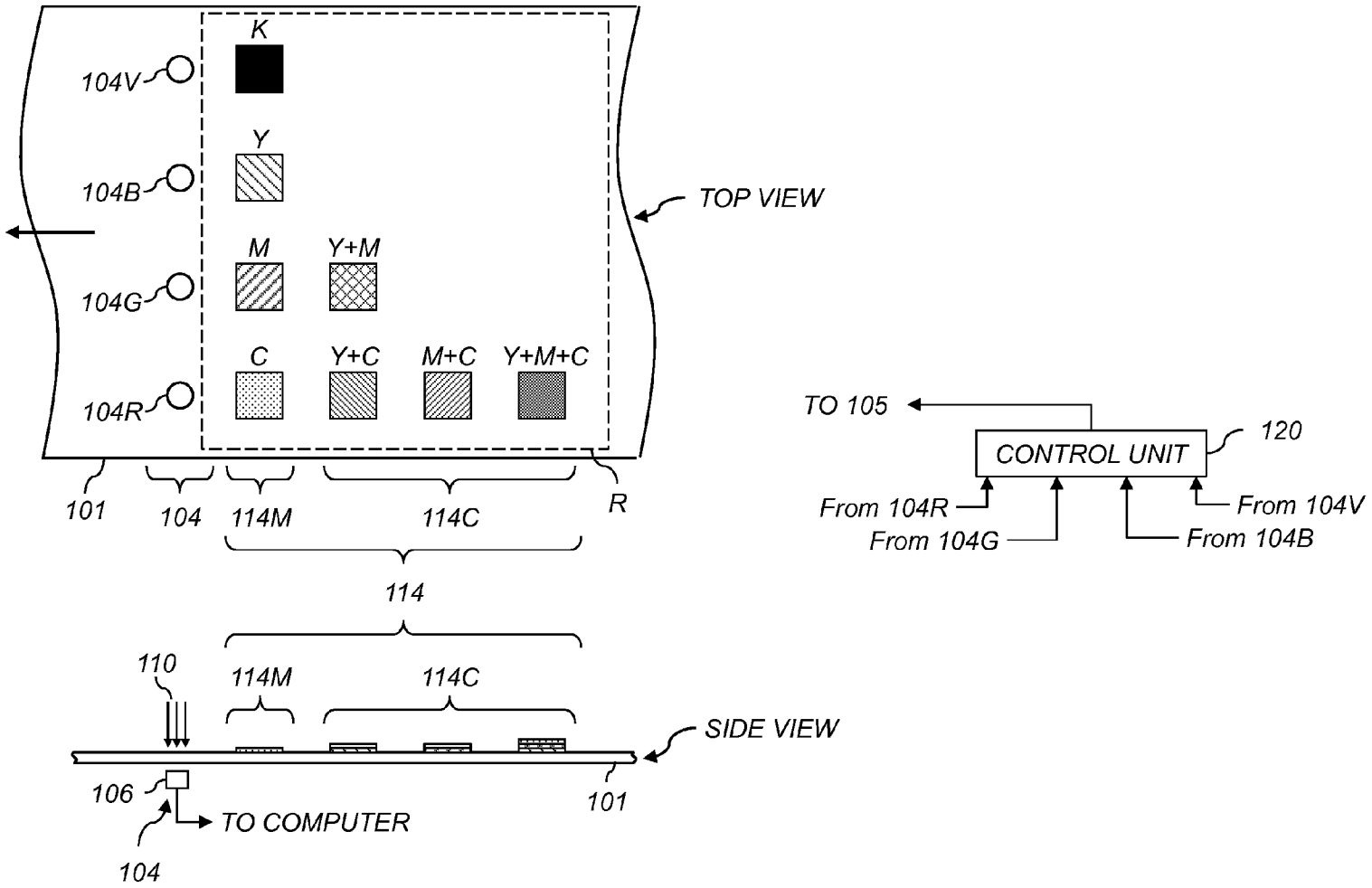
FIG. 3 shows top and side views of the densitometer module portion of the electrophotographic printer of FIG. 1.

Transfer subsystem 50 includes intermediate transfer roller ITR1 and transfer backup roller TR1 for transferring the respective print image from photoreceptor 206 of imaging roller PC1 through a first transfer nip 201 to surface 216 of intermediate transfer roller ITR1, and thence to a receiver medium R at a second transfer nip 202. The receiver medium R receives a respective toned print image 38 from each image forming module in superposition to form a composite image thereon. The print image 38 is, for example, a separation of one color, such as black. Receiver medium R is transported by transport web 101. Transfer to the receiver medium R is effected by an electrical field provided to transfer backup roller TR1 by power supply unit 105, which is controlled by control unit 120 (FIG. 3). Receiver medium R can be any object or surface onto which toner can be transferred by application of the electric field.

In the illustrated embodiment, the toner image is transferred from the photoreceptor 206 to the intermediate transfer roller ITR1, and from there to the receiver medium R. Registration of the separate toner images is achieved by registering the separate toner images on the receiver medium R, as is done with the NexPress 2100. In some embodiments, a single transfer member is used to sequentially transfer toner images from each color channel to the receiver medium R. In other embodiments, the separate toner images can be transferred in register directly from the photoreceptor 206 in the respective image forming module M1, M2, M3, M4, M5 to the receiver medium R without using an intermediate transfer roller. Either transfer process is suitable when practicing this invention. An alternative method of transferring toner images involves transferring the separate toner images, in register, to a transfer member and then transferring the registered image to a receiver.

A control system (e.g., control unit 120 of FIG. 3) sends control signals to the charging subsystem 210, the exposure subsystem 220, and the respective development station 225 of each image forming module M1, M2, M3, M4, M5 (FIG. 1), among other components. Each image forming module M1, M2, M3, M4, M5 can also have its own respective controller system.

Further details regarding exemplary printer apparatus 100 are provided in U.S. Pat. No. 6,608,641 to Alexandrovich et al., and in U.S. Patent Application Publication 2006/0133870, to Ng et al., the disclosures of which are incorporated herein by reference.

FIG. 3 shows top and side views of a portion of the printer apparatus 100 of FIG. 1, which includes the densitometer module 104. In this example, the densitometer module 104 includes a set of four transmission densitometers, each having a different spectral response. A red densitometer 104R senses light in the red portion of the color spectrum. The red densitometer 104R can be used to characterize an amount of cyan toner, since cyan toner absorbs red light. Likewise, a green densitometer 104G senses light in the green portion of the color spectrum, and can be used to characterize an amount of magenta toner, and a blue densitometer 104B senses light in the blue portion of the color spectrum, and can be used to characterize an amount of yellow toner. A visual densitometer 104V senses can be used to characterize an amount of black toner. Preferably, the visual densitometer 104V senses light in a broad portion of the color spectrum, approximately corresponding to the human visual system sensitivity. However, since black toner absorbs light across the entire color spectrum, the visual densitometer 104V can have any appropriate spectra response.

The color responses of the different densitometers can be controlled using any method known in the art. For example, in some embodiments, the light beam 110 is a white light beam including all light in all portions of the color spectrum. An appropriate color filter can be associated with each of the densitometers to provide the desired color response. For example, a red filter can be used for the red densitometer 104R to provide a red spectral response. The red filter can be placed either between the light beam 110 and the transport web 101, or between the transport web 101 and the sensor 106 in the red densitometer 104R. In other embodiments, the color response can be controlled by controlling the spectral content of the light beam 110 for each of the different densitometers. For example, the light beam 110 for the red densitometer 104R can be provided by a red light source.

In accordance with embodiments of the present inventions, a set of process control patches 114 are printed and transferred onto a measurement surface, where measurements are made to characterize the amount of transferred toner. In a preferred embodiment, the measurement surface is the transport web 101 or a piece of receiver medium R, and the transferred process control patches 114 are measured using the densitometer module 104. In other embodiments, the amount of transferred toner can be characterized using other measurement devices, such as using an off-line densitometer, or other types of measurement instrument known in the art. For example, the amount of transferred toner can be characterized by measuring capacitance values of the transferred toner, magnetic values of the transferred toner, fluorescence light levels from the transferred toner, scattered light levels from the transferred toner, or a mass of the transferred toner.

The process control patches include at least one monochrome process control patch 114M printed using only one color of toner, and at least one multi-color process control patch 114C printed using a plurality of different colors of toners. In the illustrated example, the monochrome process control patches 114M includes a cyan patch (C) printed using cyan toner, a magenta patch (M) printed using magenta toner, a yellow patch (Y) printed using yellow toner, and a black patch (K) printed using black toner. The multi-color process control patch 114C include a red patch (Y+M) printed using yellow toner overprinted with magenta toner, a green patch (Y+C) printed using yellow toner overprinted with cyan toner, a blue patch (M+C) printed using magenta toner overprinted with cyan toner, and a neutral patch (Y+M+C) printed using yellow toner overprinted with magenta and cyan toners. It will be obvious to one skilled in the art that in other embodiments, different arrangements of process control patches 114 can be used in accordance with the present invention.

In an exemplary embodiment, each of the process control patches 114 are designed to have $D_{max}$ density levels (i.e., the process control patches 114 have code values intended to provide the maximum desired print densities) for each of the toners that is used in the particular patch. However, this is not limiting. In other embodiments, the process control patches 114 can use a lower amount of some or all of the toners, or process control patches 114 can be provided having a range of different toner amounts.

The process control patches 114 are positioned so that they move past one of the densitometers as the transport web 101 moves through the system. In the illustrated embodiment, the process control patches 114 are positioned so that they are measured by the densitometer adapted to measure the top layer of toner. For example, the magenta (M) and red (Y+M) process control patches 114 are aligned with the green densitometer 104G since the magenta toner is the top toner layer in both cases.

In some embodiments, the process control patches 114 are transferred directly onto the transport web 101. For example, they can be printed in the inter-frame area 109 (FIG. 1) between sheets of the receiver medium R. Alternatively, the process control patches 114 can be printed during a system calibration process where no sheets of receiver medium R are being fed through the printer apparatus 100 (FIG. 1) so that it is not necessary to limit the patch positions to the inter-frame area 109.

In alternate embodiments, the process control patches 114 can be transferred onto a sheet of receiver medium R. In this case, it may be desirable that the densitometer module 104 use reflection densitometers where the sensors 106 are located on the same side of the transport web 101 as the light beams 110, and positioned to sense light reflected from the process control patches 114.

Control unit 120 receives signals from the densitometer module 104 (e.g., from the red densitometer 104R, the green densitometer 104G, the blue densitometer 104B and the visual densitometer 104V) providing an indication of the measured densities for the process control patches 114. In accordance with the present invention, the control unit 120 determines appropriate transfer bias settings for each of the image forming modules M1, M2, M3, M4, M5 by analyzing the measured density values. The transfer bias settings are then sent from the computer to the power supply unit 105 (FIG. 1), where they are used to control the transfer biases provided to the transfer backup rollers TR1, TR2, TR3, TR4, TR5.

Figure 4:
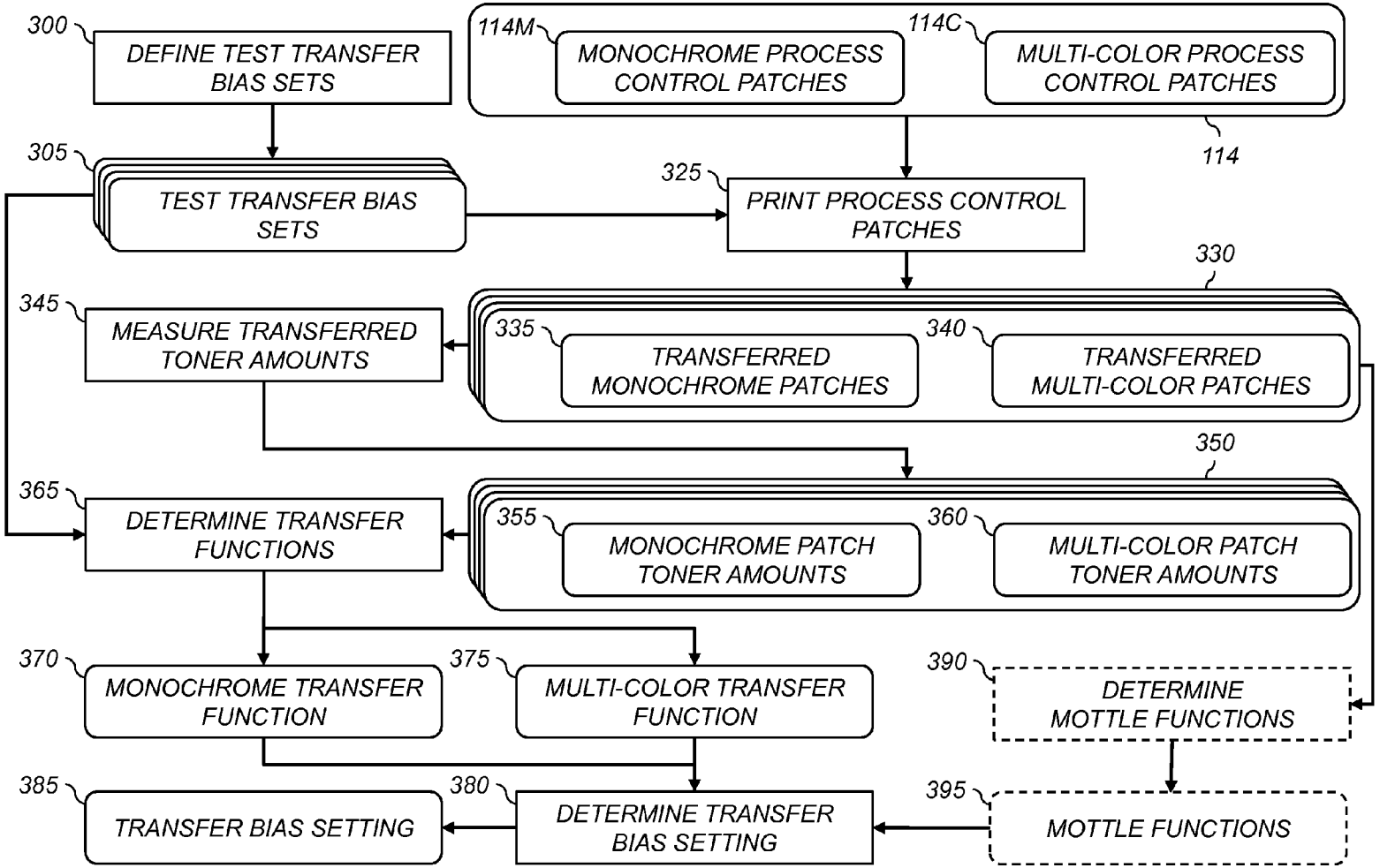
FIG. 4 shows a flowchart for determining transfer bias settings in accordance with the invention.

FIG. 4 shows a flow chart of a method to determine transfer bias settings 385 for use in an electrophotographic printing system in accordance with an exemplary embodiment of the invention. The method is preferably performed automatically during a printer calibration process. At least some of the steps will generally be performed using a data processing system associated with the electrophotographic printing system, such as the control unit 120 (FIG. 3).

A define test transfer bias sets step 300 is used to define a plurality of test transfer bias sets 305. Each test transfer bias set 305 includes a transfer bias setting for the transfer subsystem 50 (FIG. 2) in each of the image forming modules M1, M2, M3, M4, M5 (FIG. 1). In a preferred embodiment, the transfer bias settings are bias current settings. In other embodiments, the transfer bias settings can be bias voltage settings.

In some embodiments, the transfer bias settings in a particular test transfer bias set 305 will be the same for each of the image forming modules M1, M2, M3, M4, M5 (FIG. 1). For example, in one exemplary embodiment, there are five test transfer bias sets 305, where the transfer bias settings for all of the color channels are set to 15 μA, 20 μA, 25 μA, 30 μA and 35 μA, respectively (see FIG. 6A). In other embodiments, a particular test transfer bias set 305 can use different transfer bias settings for different image forming modules M1, M2, M3, M4, M5.

A print process control patches step 325 is then used to print a set of process control patches 114 using each of the test transfer bias sets 305, where the printed patches are transferred to an appropriate measurement surface (e.g., the transport web 101, or a piece or receiver medium R as discussed relative to FIG. 3) thereby providing corresponding sets of transferred process control patches 330. As discussed earlier with respect to FIG. 3, the process control patches 114 preferably include monochrome process control patches 114M, which include only a single type of toner, and multi-color process control patches 114C. (In an exemplary embodiment, the monochrome process control patches 114M include a patch printed with a first toner corresponding to a first color channel, and the multi-color process control patches 114C include at least one patch printed with the first toner and at least one additional toner corresponding to at least one additional color channel.) Accordingly, each set of transferred process control patches 330 will include transferred monochrome patches 335 and transferred multi-color patches 340.

A measure transferred toner amounts step 345 is used to characterize the amount of the transferred toner in the transferred process control patches 330, thereby providing measured transferred toner amounts 350. For embodiments where the measurement surface is a piece of receiver medium R, the process control patches 114 are transferred to the receiver medium R before they are measured. In this case, the transferred process control patches 330 can be measured in an un-fused state, or they can be measured after the toner is fused to the receiver medium R using an appropriate fusing system.

The measured transferred toner amounts 350 will include measured monochrome patch toner amounts 355 corresponding to the monochrome process control patches 114M and measured multi-color patch toner amounts 360 corresponding to the multi-color process control patches 114C. Generally, to determine the transfer bias setting 385 for a particular color channel, it is only necessary to characterize the transferred toner amounts for that color channel. For example, to determine the transfer bias setting 385 for the magenta image forming module, the amount of magenta toner in the transferred process control patches 330 should be determined. In a preferred embodiment, the measured transferred toner amounts 350 are determined using the densitometer module 104 as was discussed relative to FIG. 3. For example, the measured transferred toner amounts 350 for the magenta toner can be characterized by measuring the green density using the green densitometer 104G. It is generally not critical that the amount of toner be characterized using any particular physical quantity (e.g., as $g/m^2$), but rather it is only required that the measured values be monotonically related to the amount of transferred toner. It has been found that the optical density of the toner serves as a reasonable characterization of the toner amount. In other embodiments, the measured transferred toner amounts 350 can be characterized in terms of other quantities such as mass density (mass per unit area) or transfer efficiency (percentage of toner mass transferred to the receiver medium).

A determine transfer functions step 365 is used to determine a monochrome transfer function 370 and a multi-color transfer function 375 responsive to the measured transferred toner amounts 350. The monochrome transfer function 370 is determined by analyzing the measured monochrome patch toner amounts 355 to characterize the amount of transferred toner in the transferred monochrome patches 335 for a particular color channel associated with a particular image forming module as a function of the transfer bias setting for the transfer subsystem 50 (FIG. 2) in the particular image forming module. Similarly, the multi-color transfer function 375 is determined by analyzing the measured multi-color patch toner amounts 360 to characterize the amount of the particular toner in the transferred multi-color patches 340 as a function of the transfer bias setting for the transfer subsystem 50 (FIG. 2) in the particular image forming module.

Figure 5B:
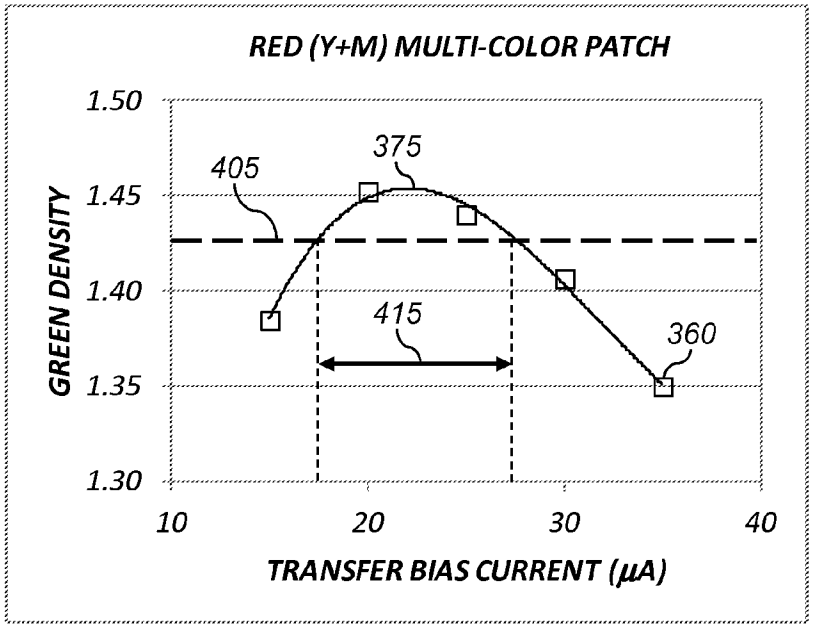
FIG. 5B illustrates an exemplary multi-color transfer function determined for a red process control patch.
Figure 5A:
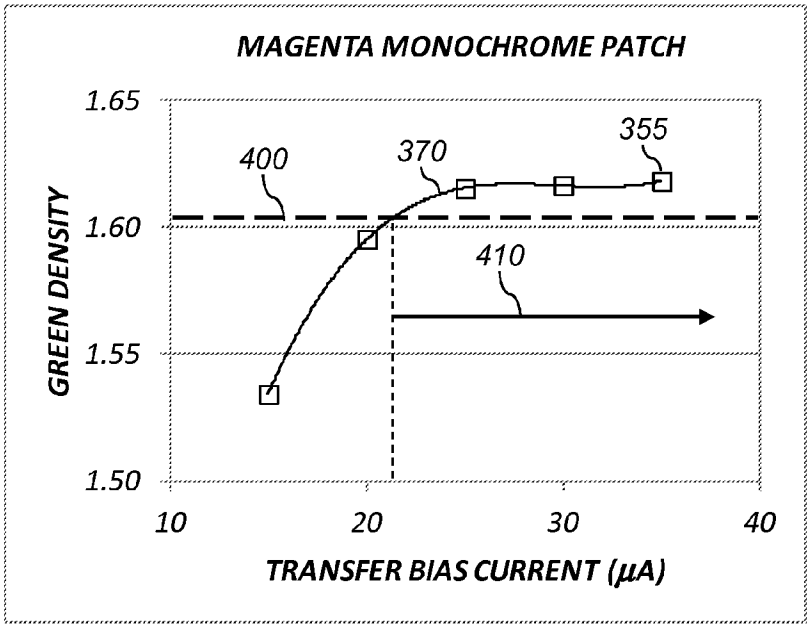
FIG. 5A illustrates an exemplary monochrome transfer function determined for a magenta process control patch.

FIG. 5A shows an example of a monochrome transfer function 370 determined for a set of measured monochrome patch toner amounts 355 determined for a set of five transfer bias settings ranging from 15 μA to 35 μA. Likewise, FIG. 5B shows an example of a multi-color transfer function 375 determined for a set of measured multi-color patch toner amounts 360. In both cases, the corresponding transfer function was determined by fitting a parametric function to the measured toner amounts (as represented by the green reflection density of the transferred process control patches 330). In this example, the parametric functions are third-degree polynomial functions of the form $y=a_0+a_1x+a_2x^2+a_3x^3$. Examples of other types of parametric functions which can be used in accordance with the present invention would include polynomial functions of other orders, power-law functions, exponential functions, logarithmic functions, sigmoid functions and logistic functions. Any fitting method known in the art (e.g., least squares regression) can be used to determine the parameters of the parametric function (e.g., $a_0$, $a_1$, $a_2$ and $a_3$ in the third-degree polynomial example). In other cases, the transfer function can be determined by using linear or cubic interpolation to connect the measured data points, by fitting a spline function to the measured data points, or by using other methods known in the art to determine a representative function from a set of measured data points.

Returning to a discussion of FIG. 4, a determine transfer bias setting step 380 is used to determine a transfer bias setting 385 for the particular color channel responsive to the monochrome transfer function 370 and the multi-color transfer function 375. The goal of this step is to determine the transfer bias setting 385 that optimizes the transfer of the toner to the receiver medium. Consider the monochrome transfer function 370 in FIG. 5A. It can be seen that as the transfer bias current is increased, the amount of magenta toner that is transferred to the receiver medium (as measured by the green density) increases until the transfer bias current reaches 25 μA, at which point the amount of transferred toner levels off. The multi-color transfer function 375 in FIG. 5B has a somewhat different shape. In this case, the multi-color transfer function 375 has a peak at a transfer bias current of approximately 22 μA. At higher transfer bias currents, the amount of transferred magenta starts to decrease. Therefore, in this example, it can be seen that the transfer bias setting 385 that provides the best transfer for the magenta toner, both with respect to the monochrome process control patches 114M and the multi-color process control patches 114C would be around 20-25 μA. The difficulty of transferring one toner layer onto another toner layer will often lead to the selection of a transfer bias setting based on multi-color process control patch measurements that differs from a transfer bias setting solely based on monochrome patch measurements.

The monochrome transfer function 370 and the multi-color transfer function 375 can be analyzed in a variety of different ways to determine the transfer bias setting 385 in accordance with the present invention. In some embodiments, the transfer bias setting 385 is determined such that the monochrome transfer function 370 and the multi-color transfer function 375 satisfy a set of predefined criteria. For example, a minimum monochrome patch transferred toner amount criterion can be defined such that the monochrome transfer function 370 is greater than a first threshold, and a minimum multi-color patch transferred toner amount criterion can be defined such that the multi-color transfer function 375 is greater than a second threshold. In an exemplary embodiment, the first threshold and the second threshold are determined based on the maximum value of the respective transfer function. For example, as shown in FIGS. 5A-5B, the first threshold 400 can be set at a level equal to 99% of the maximum value of the monochrome transfer function 370, and the second threshold 405 can be set at a level equal to 99% of the maximum value of the multi-color transfer function 375.

Comparing the monochrome transfer function 370 to the first threshold 400, it can be seen that the minimum monochrome patch transferred toner amount criterion is satisfied for a transfer bias current in a transfer bias range 410 where the transfer bias current B≥21 μA. Similarly, comparing the multi-color transfer function 375 to the second threshold 405, it can be seen that the minimum multi-color patch transferred toner amount criterion is satisfied for a transfer bias current in a transfer bias range 415 where 18 μA≤B≤27 μA. Both criteria will be satisfied within the combined transfer bias range 21 μA≤B≤27 μA. Therefore, selecting a transfer bias setting 385 in this range will provide acceptable performance. Various strategies could be used to select a particular transfer bias setting 385 within the combined transfer bias range. For example, the monochrome transfer function 370 and the multi-color transfer function 375 can be added together to form a combined transfer function. Then the transfer bias setting within the acceptable range which produces the maximum combined transfer function value can be selected to be the transfer bias setting 385. In this case, a transfer bias setting 385 near the maximum of the multi-color transfer function 375 would be selected, which would correspond to a transfer bias current of about 22 μA.

In some embodiments, the determine transfer bias setting step 380 incorporates other factors besides the monochrome transfer function 370 and the multi-color transfer function 375 during the determination of the transfer bias setting 285. For example, in some cases it has been found that the amount of "mottle" in the transferred process control patches 330 can vary as a function of the transfer bias current. Mottle is an artifact that relates to the amount of non-uniformity in an area that should otherwise be uniform.

FIG. 4 shows an optional determine mottle functions step 390 that can be used to analyze the transferred process control patches 330 to determine mottle functions 395, which characterize the amount of mottle in the transferred process control patches 330 as a function of the transfer bias setting. One way to characterize mottle is to measure the optical density at a plurality of different locations within the transferred process control patches 330. The mean of the resulting measured density values can be used to characterize the transferred toner amounts, and the standard deviation of the resulting measured density values can be used to characterize the magnitude of the variations in the transferred toner amounts (which will be representative of the amount of mottle). In an exemplary embodiment, the mottle functions 395 include a monochrome mottle function and a multi-color mottle function.

In some embodiments, the transfer bias setting 285 can be selected such that it satisfies a maximum mottle criterion such that the mottle values for the monochrome process control patches 114M and the mottle values for the multi-color process control patches 114C are less than a predefined threshold. Alternatively, the transfer bias setting 285 can be selected to be the transfer bias current within the range that produces acceptable transfer performance that produces the lowest mottle level.

In other embodiments, a "cost function" can be defined that includes both a transfer efficiency term and a mottle term, and the transfer bias setting 385 can be selected to optimize the cost function. One such cost function C is given in Eq. (1):

$$C=A_1T_M+A_2T_C+A_3S_M+A_4S_C \quad (1)$$

where $T_M$ is the monochrome transfer function 370, $T_C$ is the multi-color transfer function 375, $S_M$ is a monochrome mottle function, $S_C$ is a multi-color mottle function, and $A_1$, $A_2$, $A_3$ and $A_4$ are weighting constants that can be used to adjust the relative importance of each term in the cost function. The monochrome mottle function $S_M$ can be determined by fitting a parametric function to the mottle values determined for the transferred monochrome patches 335 (where in an exemplary embodiment the mottle values are the standard deviations of the measured densities within a patch). Likewise, multi-color mottle function $S_C$ can be determined by fitting a parametric function to the mottle values determined for the transferred multi-color patches 340.

In some embodiments, the test transfer bias sets 305 (FIG. 4) are predefined. For example, FIG. 6A shows a set of five predefined test transfer bias sets 305 where the transfer bias settings for all of the color channels are set to 15 μA, 20 μA, 25 μA, 30 μA and 35 μA, respectively. In this way, the transfer bias settings for all of the color channels can be determined by printing the set of process control patches 114 (FIG. 3) using each of the predefined test transfer bias sets 305.

While satisfactory results can be obtained by using predefined test transfer bias sets 305, in some embodiments it can be advantageous to use an iterative process to determine the transfer bias settings 385 for each color channel. With this approach, the test transfer bias sets 305 used to determine the transfer bias settings 385 for one channel can be defined responsive to the transfer bias settings 385 determined for another color channel (which were determined based on one or more previously tested test transfer bias sets 305).

For example, consider the case where a printer apparatus 100 includes five color channels: a black color channel printed by a first image-forming module M1, a yellow color channel printed by a second image-forming module M2, a magenta color channel printed by a third image-forming module M3, a cyan color channel printed by a fourth image-forming module M4, and a fifth color channel printed by a fifth image-forming module M5 for printing specialty toners. In an exemplary embodiment, the transfer bias setting 385 for the yellow color channel is determined by printing the process control patches 114 using the predefined test transfer bias sets 305. Since the yellow toner is printed before the cyan and magenta toners, it is generally not necessary to consider multi-color patches for the determination of the optimal transfer bias setting 385 for the yellow color channel.

Figure 7:
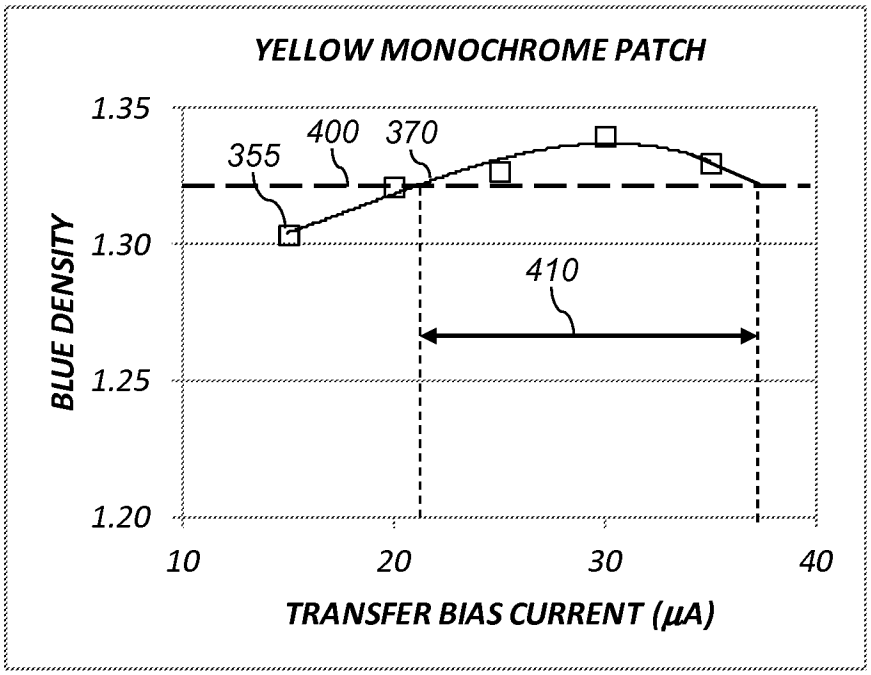
FIG. 7 illustrates an exemplary monochrome transfer function determined for a yellow process control patch.

FIG. 7 shows an example of a monochrome transfer function 370 determined from measured monochrome patch toner amounts 355 determined using the predefined test transfer bias sets 305 of FIG. 6A. An optimal transfer bias setting 385 can be selected from within the transfer bias range 410 which satisfies the criterion that the monochrome transfer function 370 is greater than the threshold 400 (which, in this example, is set to 99% of the maximum measured density in this case). In this case, the monochrome transfer function 370 peaks at a transfer bias current of 30 μA, so this can be selected for the transfer bias setting 385 for the yellow color channel.

The magenta color channel is printed next, and depending on the patch color magenta toner may be deposited on top of yellow toner. Therefore, it is desirable to set the transfer bias setting 385 for the magenta color channel by evaluating both magenta monochrome process control patches 114M and red multi-color process control patches 114C where yellow toner is overprinted by magenta toner. In this case, a set of test transfer bias sets 305 can be defined which use the determined 30 μA transfer bias setting 385 for the yellow color channel as shown in FIG. 6B. The process control patches 114 can then be printed using the test transfer bias sets 305 of FIG. 6B, and can be evaluated using the method of FIG. 4 to determine the transfer bias setting 385 for the magenta color channel. In this case, the exemplary magenta monochrome transfer function 370 (FIG. 5A) and red multi-color transfer function 375 (FIG. 5B), indicate that good results are obtained by using a transfer bias setting 385 of 22 μA for the magenta color channel.

The iterative process can then be continued by defining a new set of test transfer bias sets 305 as shown in FIG. 6C which use the determined 30 μA transfer bias setting 385 for the yellow color and the determined 22 μA transfer bias setting 385 for the magenta color. The transfer bias setting 385 for the cyan color channel can then be determined using the method of FIG. 4 by evaluating both cyan monochrome process control patches 114M together with green multi-color process control patches 114C where yellow toner is overprinted by cyan toner and blue multi-color process control patches 114C where magenta toner is overprinted by cyan toner. Optionally, neutral multi-color process control patches 114C can also be evaluated where yellow toner is overprinted by both magenta and cyan toners.

In the previous examples, the test transfer bias sets 305 include a monotonic series of transfer bias settings which are well-suited to determine one-dimensional monochrome transfer functions 370 and multi-color transfer functions 375. In some embodiments, the test transfer bias sets 305 can include a two-dimensional (or three-dimensional lattice) of different transfer bias settings to enable the determination of multi-dimensional transfer functions. For example, the test transfer bias sets 305 can include a lattice of four different transfer bias settings for the yellow color channel, four different transfer bias settings for the magenta color channel and four different transfer bias settings for the cyan color channel, for a total of 4×4×4=64 different test transfer bias sets 305. The process control patches 114 can be printed using each of the test transfer bias sets 305, and the resulting measured transferred toner amounts 350 can be evaluated to determine three-dimensional monochrome transfer functions 370 of the form $T_M(B_y, B_m, B_c)$ and three-dimensional multi-color transfer functions 375 of the form $T_C(B_y, B_m, B_c)$, where $B_y$ is the yellow bias setting, $B_m$ is the magenta bias setting, and $B_c$ is the cyan bias setting. The transfer bias settings 385 for all three color channels can then be determined simultaneously by evaluating all of the transfer functions to identify a set of transfer bias settings 385 that provide acceptable performance for all of the process control patches 114.

The performance of the transfer subsystems 50 in the electrophotographic printer apparatus 100 can be affected by a variety of different factors including environmental conditions, and the characteristics of the receiver medium. As a result, it may be desirable to perform the method of the present invention at various times in order to optimize the performance of the printer apparatus 100. For example, the method can be performed any time a new type of receiver medium is used in the printer apparatus 100. In some embodiments, the determined transfer bias settings 385 for a particular receiver medium type can be stored in memory and can be recalled the next time that that type of receiver medium is used. In some embodiments, the method can be performed at regular time intervals (e.g., during a daily calibration process) to account for changing environmental conditions. Alternatively, it can be performed on an as-needed basis when an operator notices that the performance has degraded.

The invention has been described in detail with particular reference to certain preferred embodiments thereof, but it will be understood that variations, combinations, and modifications can be effected by a person of ordinary skill in the art within the spirit and scope of the invention.

PARTS LIST

38 print image
50 transfer subsystem
86 cleaning station
100 printer apparatus
101 transport web
102 roller
103 roller
104 densitometer module
104R red densitometer
104G green densitometer
104B blue densitometer
104V visual densitometer
105 power supply unit
106 sensor
109 inter-frame area
110 light beam
114 process control patches
114M monochrome process control patches
114C multi-color process control patches
120 control unit
124 corona charger
125 corona charger
201 first transfer nip
202 second transfer nip
206 photoreceptor
210 charging subsystem
211 meter
212 meter
213 grid
216 surface
220 exposure subsystem
225 development station
226 toning shell
227 magnetic core
230 developer supply
234 developer
300 define test transfer bias sets step
305 test transfer bias sets
325 print process control patches step
330 transferred process control patches
335 transferred monochrome patches
340 transferred multi-color patches
345 measure transferred toner amounts step
350 measured transferred toner amounts
355 monochrome patch toner amounts
360 multi-color patch toner amounts
365 determine transfer functions step
370 monochrome transfer function
375 multi-color transfer function
380 determine transfer bias setting step
385 transfer bias setting
390 determine mottle functions step
395 mottle functions
400 threshold
405 threshold
410 transfer bias range
415 transfer bias range
ITR1 intermediate transfer roller
ITR2 intermediate transfer roller
ITR3 intermediate transfer roller
ITR4 intermediate transfer roller
ITR5 intermediate transfer roller
M1 image-forming module
M2 image-forming module
M3 image-forming module
M4 image-forming module
M5 image-forming module
PC1 imaging roller
PC2 imaging roller
PC3 imaging roller
PC4 imaging roller
PC5 imaging roller
R receiver medium
S slow-scan direction
TR1 transfer backup roller
TR2 transfer backup roller
TR3 transfer backup roller
TR4 transfer backup roller
TR5 transfer backup roller

The invention claimed is:

1. A method for determining transfer bias settings in an electrophotographic printing system having a plurality of printing modules, each printing module including a respective transfer subsystem operated at an associated transfer bias setting adapted to transfer a respective toner image of a respective color channel to a receiver medium, comprising:

defining a plurality of test transfer bias sets, each test transfer bias set including a transfer bias setting for the transfer subsystem in each of the printing modules;

for each of the defined test transfer bias sets, transferring toner for a plurality of process control patches onto a measurement surface using the transfer subsystems of the printing modules, each transfer subsystem being operated at the respective transfer bias setting, wherein the plurality of process control patches includes a monochrome patch printed using a first toner corresponding to a first color channel corresponding to a particular printing module and at least one multi-color patch printed using the first toner and at least one additional toner corresponding to at least one additional color channel;

performing measurements to characterize amounts of the first toner on the transferred process control patches;

analyzing the measured toner amounts to determine a monochrome transfer function characterizing the amount of the first toner in the transferred monochrome patches as a function of the transfer bias for the transfer subsystem in the particular printing module;

analyzing the measured toner amounts to determine a multi-color transfer function characterizing the amount of the first toner in the transferred multi-color patches as a function of the transfer bias for the transfer subsystem in the particular printing module; and determining the transfer bias setting for the transfer subsystem in the particular printing module responsive to the monochrome transfer function and the multi-color transfer function.

2. The method of claim 1 wherein the determination of the transfer bias setting includes evaluating the monochrome transfer function and the multi-color transfer function to determine a transfer bias setting that satisfies one or more predefined criteria.

3. The method of claim 2 wherein the predefined criteria include a minimum monochrome patch transferred toner amount criterion and a minimum multi-color patch transferred toner amount criterion.

4. The method of claim 2 further including measuring mottle values for the transferred process control patches, the mottle values characterizing variations in measured toner amounts within the transferred process control patches, and wherein the predefined criteria include a mottle criterion which is evaluated responsive to the measured mottle values.

5. The method of claim 1 wherein the determination of the transfer bias setting includes evaluating a cost function which includes the monochrome transfer function and the multi-color transfer function.

6. The method of claim 5 further including measuring mottle values for the transferred process control patches, the mottle values characterizing variations in measured toner amounts within the transferred process control patches, and wherein the cost function further includes one or both of a monochrome mottle function characterizing the mottle values in the transferred monochrome patches as a function of the transfer bias and a multi-color mottle function characterizing the mottle values in the transferred multi-color patches as a function of the transfer bias.

7. The method of claim 1 further including measuring mottle values for the transferred process control patches, the mottle values characterizing variations in measured toner amounts within the transferred process control patches, and wherein the determination of the transfer bias setting is also responsive to the measured mottle values.

8. The method of claim 1 wherein the determination of the monochrome transfer function includes fitting a parametric function to the measured amount of the first toner in the transferred monochrome patches as a function of the transfer bias, and the determination of the multi-color transfer function includes fitting a parametric function to the measured amount of the first toner in the transferred multi-color patches as a function of the transfer bias.

9. The method of claim 1 wherein the plurality of test transfer bias sets are predefined.

10. The method of claim 1 wherein the at least one of the test transfer bias sets is defined responsive to one or more previously tested test transfer bias sets.

11. The method of claim 1 wherein the monochrome transfer function is a multi-dimensional function characterizing the amount of the first toner in the transferred monochrome patches as a function of the transfer bias for the transfer subsystem in the particular printing module as well as the transfer bias for the transfer subsystem in at least one additional printing module.

12. The method of claim 1 wherein the measurement surface is a transfer web or the receiver medium.

13. The method of claim 1 wherein transfer bias settings are determined for transfer subsystems in a plurality of printing modules.

14. The method of claim 1 further including using the determined transfer bias setting to transfer a toner pattern corresponding to an image to a receiver.

15. The method of claim 1 wherein the measured toner amounts are characterized by optical density values.

16. The method of claim 15 wherein the optical density values are determined using a densitometer having a spectral response adapted to characterize the amounts of the first toner in the transferred process control patches.

17. The method of claim 15 wherein the optical density values are reflection density values or transmission density values.

18. The method of claim 15 wherein the optical density values are determined using a densitometer internal to the electrophotographic printing system.

19. The method of claim 1 wherein the measured toner amounts are characterized by capacitance values of the transferred toner, magnetic values of the transferred toner, fluorescence light levels from the transferred toner, scattered light levels from the transferred toner, or a mass of the transferred toner.

* * * * *